US007845790B2

(12) United States Patent
Baker et al.

(10) Patent No.: US 7,845,790 B2
(45) Date of Patent: Dec. 7, 2010

(54) INK JET PRINTING

(75) Inventors: Richard Baker, West Lebanon, NH (US); John Dayton, Lebanon, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 1139 days.

(21) Appl. No.: 11/400,444

(22) Filed: Apr. 7, 2006

(65) Prior Publication Data

US 2007/0236545 A1 Oct. 11, 2007

(51) Int. Cl.
*B41J 2/01* (2006.01)

(52) U.S. Cl. ..... 347/104; 347/101

(58) Field of Classification Search ..... 347/85, 347/101, 104

See application file for complete search history.

(56) References Cited

U.S. PATENT DOCUMENTS

| | | | | |
|---|---|---|---|---|
| 5,225,852 | A | 7/1993 | Uchida et al. | |
| 5,291,227 | A | 3/1994 | Suzuki | |
| 5,717,446 | A | 2/1998 | Teumer et al. | |
| 6,350,009 | B1 * | 2/2002 | Freund et al. | 347/35 |
| 6,565,183 | B2 | 5/2003 | Goto et al. | |
| 6,631,976 | B2 | 10/2003 | Hamamoto et al. | |
| 2002/0041303 | A1 | 4/2002 | Yoshinaga | |
| 2002/0154202 | A1 * | 10/2002 | Yamamoto et al. | 347/104 |
| 2003/0151639 | A1 | 8/2003 | Takahashi | |
| 2004/0046852 | A1 * | 3/2004 | Pham et al. | 347/104 |
| 2004/0095404 | A1 | 5/2004 | Iwao et al. | |
| 2004/0119777 | A1 * | 6/2004 | Nakashima et al. | 347/32 |
| 2004/0228669 | A1 | 11/2004 | Nakashima et al. | |
| 2005/0200680 | A1 * | 9/2005 | Uchida | 347/104 |
| 2005/0285894 | A1 | 12/2005 | Nakayama | |
| 2006/0050099 | A1 * | 3/2006 | Murakami et al. | 347/19 |
| 2006/0132513 | A1 | 6/2006 | Ozaki et al. | |

FOREIGN PATENT DOCUMENTS

| | | |
|---|---|---|
| CN | 1 781 709 | 6/2006 |
| EP | 1 008 454 | 6/2000 |
| EP | 1040930 A2 | 10/2000 |
| EP | 1 063 095 | 12/2000 |
| EP | 1 457 347 | 9/2004 |
| EP | 1 666 259 | 6/2006 |

OTHER PUBLICATIONS

Office Action issued in Chinese Patent Application No. 200780016007.0 dated Feb. 12, 2010.

Office Action issued in Chinese Patent Application No. 200780021603.8 dated Jan. 29, 2010.

Office Action issued in European Patent Application No. 07 757 726.0 dated Nov. 2, 2009.

Supplementary European Search Report issued in European Patent Application No. 07 76 0419 dated Feb. 9, 2010.

* cited by examiner

*Primary Examiner*—Matthew Luu
*Assistant Examiner*—Kendrick X Liu
(74) *Attorney, Agent, or Firm*—Fish & Richardson P.C.

(57) ABSTRACT

An ink jet printing system includes an ink jet print head configured to deliver ink drops to a substrate, a support member having a plurality of protrusions configured to carry the substrate by being in contact with the lower surface of the substrate, and a substrate conveying mechanism configured to cause relative movement between the ink jet print head and the support member.

14 Claims, 1 Drawing Sheet

INK JET PRINTING

TECHNICAL FIELD

This application relates to the field of ink jet printing.

BACKGROUND

Ink jet printing is a non-impact method that produces droplets of ink that are deposited on a substrate such as paper or transparent film in response to an electronic digital signal. In various commercial or consumer applications, there is a general need to provide ink jet images that are printed edge-to-edge on an ink substrate. There is also a need for printing ink images on irregular and/or small ink substrates such as candy and cookies.

Ink jet printing systems generally are of two types: continuous stream and drop-on-demand. In continuous stream ink jet systems, ink is emitted in a continuous stream under pressure through at least one orifice or nozzle. Multiple orifices or nozzles also may be used to increase imaging speed and throughput. The ink is ejected out of orifices and perturbed, causing it to break up into droplets at a fixed distance from the orifice. At the break-up point, the electrically charged ink droplets are passed through an applied electric field that is controlled and switched on and off in accordance with digital data signals. Charged ink droplets are passed through a controllable electric field, which adjusts the trajectory of each droplet in order to direct it to either a gutter for ink deletion and recirculation or a specific location on a recording medium to create images. The image creation is controlled by electronic signals.

In drop-on-demand systems, a droplet is ejected from an orifice directly to a position on a recording medium by pressure created by, for example, a piezoelectric device, an acoustic device, or a thermal device controlled in accordance with digital data signals. An ink droplet is not generated and ejected through the nozzles of an imaging device unless it is to be placed on the recording medium.

SUMMARY

In one aspect, an ink jet printing system having an ink jet print head configured to deliver ink drops to a substrate, a support member having a plurality of protrusions configured to carry the substrate by being in contact with the lower surface of the substrate, and a substrate conveying mechanism configured to cause relative movement between the ink jet print head and the support member. In another aspect, a fluid delivery system having a fluid delivery head configured to deliver fluid drops to a substrate, and a support member having a plurality of protrusions configured to carry the substrate by being in contact with the lower surface of the substrate.

In yet another aspect, a method for printing an ink image on a substrate including providing a support member having a plurality of protrusions over the surface of the support member, placing a substrate over the plurality of protrusions, and disposing ink drops from an ink jet print head on the substrate.

Implementations of the system may include one or more of the following features. The fluid delivery system can further include a substrate conveying mechanism configured to cause relative movement between the fluid delivery head and the support member. The fluid delivery system can have a controller configured to control the fluid delivery head to deliver fluid to the substrate and to control the substrate conveying mechanism to cause relative movement between the fluid delivery head and the support member. At least a portion of the support member can include a substantially flat surface. The protrusions can be so configured that the substrate carried by the protrusions is substantially parallel to the surface of the support member. The protrusions can include tapered ends adapted to carry the substrate. The support member can include one or more conveying belts. The support member can include one or more continuous conveying belts. The ink jet printing system can further include a print head transport mechanism capable of moving the ink jet print head relative to the substrate. The ink jet printing system can further include one or more sensors configured to detect the location or the orientation of the ink substrate. The ink jet print head can deliver ink drops to form an ink image on the substrate. The ink image can be printed full bleed along at least one edge of the substrate. The substrate can include at least one irregular-shaped edge. The ink jet printing system can further include an ink absorbing material over the surface of the support member.

Embodiments may include one or more of the following advantages. The disclosed fluid delivery system can be capable of full bleed printing while reducing or preventing the contamination of the substrate by the overspray fluids. The disclosed fluid delivery system can be capable of printing ink images on small and irregular shaped substrates without the need or with greater tolerance for pre-aligning the substrates before printing. Fluid delivery systems can print full bleed over and to the edges of the irregular shaped substrates. Furthermore, the system can provide effective methods and mechanisms for cleaning the overspray fluids.

The details of one or more embodiments are set forth in the accompanying drawing and in the description below. Other features, objects, and advantages of the invention will become apparent from the description and drawings, and from the claims.

DETAILED DESCRIPTION

Figure 1:
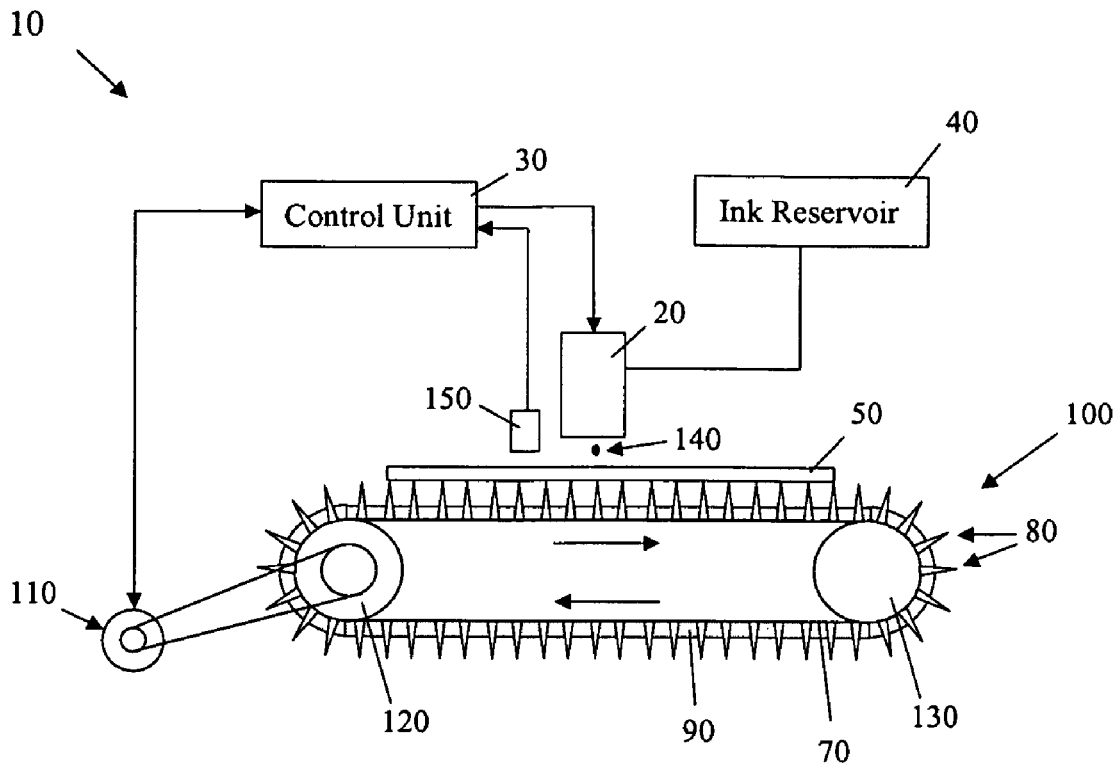
FIG. 1 illustrates an ink jet printing system having an ink jet print head and an ink substrate transport system.

FIG. 1 shows an ink jet printing system 10 including an ink jet print head 20, controller unit 30 that provides image data and other digital data to the ink jet print head 20, and ink reservoir 40 for supplying ink to the ink jet print head 20.

An ink substrate 50 is transported by an ink substrate transport system 100. The ink substrate transport system 100 includes at least one conveyor belt 70, rollers 120 and 130 for driving the conveyor belt 70, and a motor 110 that can drive the roller 120 under the control of the control unit 30. A plurality of protrusions 80 extend from a surface of the conveyer belt 70. The substrate 50 is placed over and supported by the protrusions 80. The lower surface of the substrate 50 is in contact with the tip of the protrusions 80. The substrate 50 is carried by the protrusions 80 to positions under the ink jet print head 20 to receive ink drops 140 ejected by the ink jet print head 20. Substrates compatible with the present invention include paper or man-made image substrates for displaying images including opaque, translucent, or transparent materials. The substrates can also include foods such as cookies, candies, and cakes. The substrates can also comprise plastics, ceramics, stone, metallic substrate, wood, and fabrics.

The protrusions 80 can be provided by a plurality of protruding objects that are joined to the conveyor belt 70. The protruding objects can be fixed to the conveyer belt, or formed integrally with the conveyer belt. The protrusions 80 can be made of rubber materials molded onto the conveyor belt 70. The protrusions 80 can also be solid materials plugged or screwed onto the conveyor belt 70.

The protrusions 80 are typically sparsely distributed to limit contact area to the lower surface of the substrate 50. The density and the size of the protrusions can be scaled to the size of the substrates 50. For example, for 8"×10" sized substrates, the protrusions 80 can be distributed one inch apart in a two-dimensional array. The width of the protrusions 80 can be narrower than ⅛ or 1/16 of an inch. The protrusions 80 can comprise undersides near the surface of the conveyor belt 70 and outer ends pointing outward from the conveyor belt 70. The outer ends can be tapered and narrower than the underside of the protrusions. The tapered outer ends of the protrusions 80 further limit the contact area between the protrusions 80 and the substrate 50.

In one arrangement, the conveyor belt has a plurality of protrusions. The tips of the protrusions form a plane on which the substrate rests. The substrate travels along the protrusions of the conveyor belt as the conveyor belt moves underneath the printhead. The plane of the protrusions on which the substrate rests can be parallel to the conveyor belt. Alternatively, the conveyor belt 70 can be mounted on a cylindrically shaped rotating drum. The conveyor belt 70 can be continuous as shown in FIG. 1, or tensioned between a feeding roll and a receiving roll.

In another embodiment, the protrusions 80 for carrying substrate 50 may be fixed over a non-moving support member. The ink jet print head is transported by a print head transport system. The ink jet print head scans the substrate 50 during the printing of the ink image on the ink substrate 50.

One or more sensors 150 can detect the position and orientation of the ink substrate 50. The sensors 150 can include a plurality of photo diodes disposed at pre-determined locations, or image sensors that can detect images of at least a portion of the substrate 50. Each of the photo diodes is illuminated by a light beam over a distance. The arrival of the substrate 50 interrupts the light beam and thus producing an electric signal. The correlations between the locations and timings of the light-beam interruption can be used to compute the substrate's position and the orientation. Similarly, the image captured by the image sensors can be processed by a pattern-recognition software to determine locations and orientations of the substrate 50. The detection of the positions of the ink substrate 50 can be triggered by the edges of the ink substrate 50. The detection of the position of the ink substrate can facilitate the printing of the ink pattern on the ink substrate 50 from the leading edge and around the edges of the ink substrate 50. The ink overspray outside of the edges of the substrate 50 can be captured by the conveyor belt without accumulation near the undersides of the substrates 50. Ink contamination on the ink substrates is a known issue in substrate transport mechanisms without the protrusions 80, especially for full bleed ink jet printing.

The limited contact area between the protrusions 80 and the lower surface of the ink substrate 50 significantly reduces the probability of ink contamination at the lower surface of the ink substrate 50. Furthermore, the ink substrate 50 is preferably positioned such that none of the tips of the protrusions 80 are not in contact with the edges of the substrate 50.

The ink jet printing system is particularly useful for printing small and/or irregular shaped ink substrates such as goldfish, cookies, and candy. The term irregular shape refers to a substrate that has at least one edge that is not straight. The positions and the orientations of the small and/or irregular shaped ink substrates can be detected by one or more sensors 150. The ink pattern printed can be full bleed along at least one edge of the substrate 50. The overspray can be captured by the conveyor belt 70 without contaminating the undersides of the ink substrates because of the space separating the undersides of the ink substrate 50 and the conveyor belt 70. The ink pattern can also be automatically adjusted according to the specific orientation of the substrate 50. The ink jet printing system therefore enables the ink jet printing on irregular shaped ink substrates without the need for aligning the substrates 50 on the conveyor belt 70.

The conveyor belt 70 and the plurality of protrusions 80 are preferably cleaned regularly by wiping, blotting, washing, etc. after printing one or more batches of ink substrates 50. The ink substrate transport system 100 can further include absorbent material 90 near the underside of the protrusions 80 over the conveyor belt 70. The ink absorbing materials can include foam, gel, and paper based materials. Preferably, the absorbent material 90 is replaceable or disposable to keep ink substrate transport 100 clean. The absorbent material 90 can include man made or natural materials. The absorbent material 90 can also be tailored to be most effective in absorbing the specific types of inks used for each batch of ink substrates: for example, aqueous, solvent types of inks.

Ink types compatible with the ink jet printing system described include water-based inks, solvent-based inks, and hot melt inks. The colorants in the inks can comprise dye or pigment. Furthermore, the ink jet printing system disclosed is also compatible with delivering other fluids such as polymer solutions, gel solutions, solutions containing particles, low molecular-weight molecules, which may or may not include any colorant, flavors, nutrients, biological fluids, or electronic fluids.

What is claimed is:

1. A fluid delivery system, comprising:

a fluid delivery head configured to deliver fluid drops to a substrate;

a support member comprising a conveyor belt, the conveyor belt having a plurality of protrusions projecting from the conveyor belt in a two-dimensional array, each protrusion of the plurality of protrusions having an outer end and an underside, the underside being connected to a surface of the conveyor belt; and an absorbent material on at least a portion of the surface of the conveyor belt, the absorbent material located near the underside of the plurality of protrusions, the plurality of protrusions extending through the absorbent material such that the outer end of each protrusion projects beyond the absorbent material such that the outer end of at least some of the protrusions are configured to support the substrate by being in contact with the lower surface of the substrate.

2. The fluid delivery system of claim 1, further comprising a substrate conveying mechanism configured to cause relative movement between the fluid delivery head and the support member.

3. The fluid delivery system of claim 1, further comprising a controller configured to control the fluid delivery head to deliver fluid drops to the substrate and to control the substrate conveying mechanism to cause relative movement between the fluid delivery head and the support member.

4. The fluid delivery system of claim 1, wherein at least a portion of the conveyor belt comprises a substantially flat surface.

5. The fluid delivery system of claim 1, wherein the protrusions are so configured that the substrate carried by the protrusions is substantially parallel to the surface of the support member.

6. The fluid delivery system of claim 1, wherein the the outer end is tapered.

7. The fluid delivery system of claim 1, wherein the conveyor belt is a continuous belt.

8. The fluid delivery system of claim 1, further comprising a print head transport mechanism capable of moving the fluid delivery head relative to the substrate.

9. The fluid delivery system of claim 1, further comprising a controller configured to cause the fluid delivery head to deliver ink drops to form an ink image on the substrate.

10. The fluid delivery system of claim 9, wherein the fluid delivery head is configured to print full bleed along at least one edge of the substrate.

11. The fluid delivery system of claim 1, wherein the conveyor belt is tensioned between a feeding roll and a receiving roll.

12. The fluid delivery system of claim 1, further comprising two spaced-apart rollers supporting the conveyor belt, wherein a portion of the conveyor belt suspended between the two spaced-apart rollers has a substantially planar portion.

13. The fluid delivery system of claim 12, wherein the fluid delivery head is positioned over the substantially planar portion of the conveyor belt.

14. The fluid delivery system of claim 1, further comprising a fluid reservoir to supply fluid to the fluid delivery head, and wherein the fluid in the fluid reservoir comprises ink.

* * * * *

UNITED STATES PATENT AND TRADEMARK OFFICE

CERTIFICATE OF CORRECTION

PATENT NO. : 7,845,790 B2
APPLICATION NO. : 11/400444
DATED : December 7, 2010
INVENTOR(S) : Richard J. Baker et al.

It is certified that error appears in the above-identified patent and that said Letters Patent is hereby corrected as shown below:

Column 5:

Claim 6, line 1:

Delete “the the” and insert --the--

Signed and Sealed this
Twenty-fourth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,845,790 B2
APPLICATION NO. : 11/400444
DATED : December 7, 2010
INVENTOR(S) : Richard J. Baker et al.

It is certified that error appears in the above-identified patent and that said Letters Patent is hereby corrected as shown below:

Column 5, line 5

(Claim 6, line 1)

Delete "the the" and insert --the--

This certificate supersedes the Certificate of Correction issued May 24, 2011.

Signed and Sealed this
Twenty-first Day of June, 2011

David J. Kappos

David J. Kappos
*Director of the United States Patent and Trademark Office*